US010249148B2

(12) United States Patent
Chu et al.

(10) Patent No.: US 10,249,148 B2
(45) Date of Patent: Apr. 2, 2019

(54) INTERACTIVE TREASURE-HUNTING METHOD AND SYSTEM

(71) Applicant: En-Shin Chu, Taichung (TW)

(72) Inventors: En-Shin Chu, Taichung (TW); Yu-Tsen Huang, Taichung (TW); Kuan-Wei Huang, Taichung (TW)

( * ) Notice: Subject to any disclaimer, the term of this patent is extended or adjusted under 35 U.S.C. 154(b) by 143 days.

(21) Appl. No.: 15/465,604

(22) Filed: Mar. 22, 2017

(65) Prior Publication Data

US 2018/0276954 A1 Sep. 27, 2018

(51) Int. Cl.
*G07F 17/00* (2006.01)
*G07F 17/32* (2006.01)
*A63F 9/30* (2006.01)

(52) U.S. Cl.
CPC ..... *G07F 17/3297* (2013.01); *A63F 9/30* (2013.01); *G07F 17/3223* (2013.01); *G07F 17/3246* (2013.01)

(58) Field of Classification Search
CPC ... A63F 9/30; A63F 9/24; G07F 17/34; G07F 17/3295
See application file for complete search history.

(56) References Cited

U.S. PATENT DOCUMENTS

2009/0191931 A1* 7/2009 Peck ..... G07F 17/32 463/7
2010/0268792 A1* 10/2010 Butler ..... G06Q 30/02 709/217
2011/0272887 A1* 11/2011 McGrath ..... A63F 9/30 273/448
2017/0352228 A1* 12/2017 Kramer ..... G07F 17/3211

* cited by examiner

*Primary Examiner* — Reginald Renwick

(57) ABSTRACT

An interactive treasure-hunting game system includes a treasure-hunting game machine, a control module, a portable device and a server. The treasure-hunting game machine contains objects. The control module is inserted in and operatively connected to the treasure-hunting game machine. The control module, the portable device and the server are connected to one another via the internet.

10 Claims, 6 Drawing Sheets

INTERACTIVE TREASURE-HUNTING METHOD AND SYSTEM

BACKGROUND OF INVENTION

1. Field of Invention

The present invention relates to entertainment and, more particularly, to an interactive treasure-hunting method and system.

2. Related Prior Art

People are under heavier and heavier pressure because people have less and less time and space to exercise to release stress. Some people come to video games for entertainment to release stress and improve health. A game machine like a doll-clipping machine is a common choice for such entertainment. Such a game machine includes a space for containing products such as fluffy dolls and electronic products and a maneuver device operable to instruct a product-capturing device to capture one of the products and then drop the product onto a chute which in turn sends the product to a player standing in front of the game machine. Such maneuver is fun and entertaining.

However, such a game machine shows all of the products to people. It is not attractive if the products are cheap. It is attractive if the products are expensive. In the second case, an owner of the game machine is forced to lower the odds to make an adequate profit from the game machine. Such low odds will drive people away from the game machine in the long run. Moreover, such a game machine is operated as a stand-alone machine that cannot be connected to a remote server. The ways of operating such a game machine are limited, and so is the fun the player can get from operating it. Furthermore, such a game machine cannot be used for desirable advertisement or marketing.

The present invention is therefore intended to obviate or at least alleviate the problems encountered in prior art.

SUMMARY OF INVENTION

It is an objective of the present invention to provide an interactive treasure-hunting game system for providing a new manner of playing the game to increase the effects of game and hence attraction.

The interactive treasure-hunting game system includes at least one treasure-hunting game machine, at least one control module, at least one portable device and a server. The treasure-hunting game machine includes a space, an object-capturing unit, a maneuver unit, a display unit and an identification unit. The space includes a capture area for containing objects each provided with an RFID tag and a scan area in communication with the capture area. The object-capturing unit is located in the space. The maneuver unit is provided on the treasure-hunting game machine and operable to control the object-capturing unit to capture one of the objects from the capture area and then drop the object into the scan area. The display unit is provided on the treasure-hunting game machine. The identification unit is provided on the treasure-hunting game machine. The control module is located in the treasure-hunting game machine and includes a processing unit, an initiating unit and a tag scanner. The processing unit is electrically connected to the object-capturing unit, the maneuver unit and the display unit. The initiating unit is electrically connected to the processing unit. The tag scanner is located in the scan area of the treasure-hunting game machine, electrically connected to the processing unit, and adapted for scanning the RFID tag of the object so that a code carried by the RFID tag of the object can be translated and shown on the display unit. The portable device includes an initiating module for obtaining identity data of a player and that of the treasure-hunting game machine, a scanning module for reading the identification unit of the treasure-hunting game machine, and a web-connecting module for communicating data via the internet. The server includes a management module, a storage module used with the management module to run statistics and management of game data of the player, and a web-connecting module for connection to the portable device.

It is another objective of the present invention to provide a method for operating the interactive treasure-hunting game system.

To achieve the foregoing objective, the method includes the steps of initiating the system, reading the identity data of the treasure-hunting game machine, connecting the system, checking the identities, turning on treasure-hunting game machine if the player and the treasure-hunting game machine are qualified, starting a round of game, and updating the data. The step of initiating the system includes the step of turning on the initiating module of the portable device to log in. The step of reading the identity data of the treasure-hunting game machine includes the step of using the scanning module of the portable device to scan the identification unit of the treasure-hunting game machine. The step of connecting the system includes the step of connecting the portable device to the server via the web-connecting modules and the step of sending the identity data of the player and the identity data of the treasure-hunting game machine to the server. To check the identities, the management module of the server is used to check the identity data of the player and the identity data of the treasure-hunting game machine sent from the portable device to determine whether if the player and the treasure-hunting game machine are qualified. Moreover, the process is turned to the step of initiating the system to invite the player to register for membership if the player is not a qualified player. Alternatively, the game is terminated if the treasure-hunting game machine is not a qualified machine. The treasure-hunting game machine is turned on if the player and the treasure-hunting game machine are qualified by using the server to send the game mission command to the treasure-hunting game machine. The virtual initiating unit of the initiating unit of the treasure-hunting game machine is instructed to turn on the treasure-hunting game machine according to the data stored in the storage module. To start a round of game, the player uses the control module of the treasure-hunting game machine to control the object-capturing unit to capture a selected one of the objects. The scan unit of the treasure-hunting game machine is used to scan the RFID tag of the object. The processing unit of the control module is used to translate the code carried by the RFID tag to numbers, alphabets, words or graphics and show them on the display unit to invite the player to play the game according to the game mission commands from the server. To update the data after the player stops playing with the treasure-hunting game machine, the processing unit is used to send the game data to the management module of the server via the web-connecting modules to allow the server to run statistics, analysis, comparison and management on the data and store the game data in the storage module.

Other objectives, advantages and features of the present invention will be apparent from the following description referring to the attached drawings.

DESCRIPTION OF DRAWINGS

The present invention will be described via detailed illustration of the preferred embodiment referring to the drawings wherein.

DETAILED DESCRIPTION OF INVENTION

Figure 1:
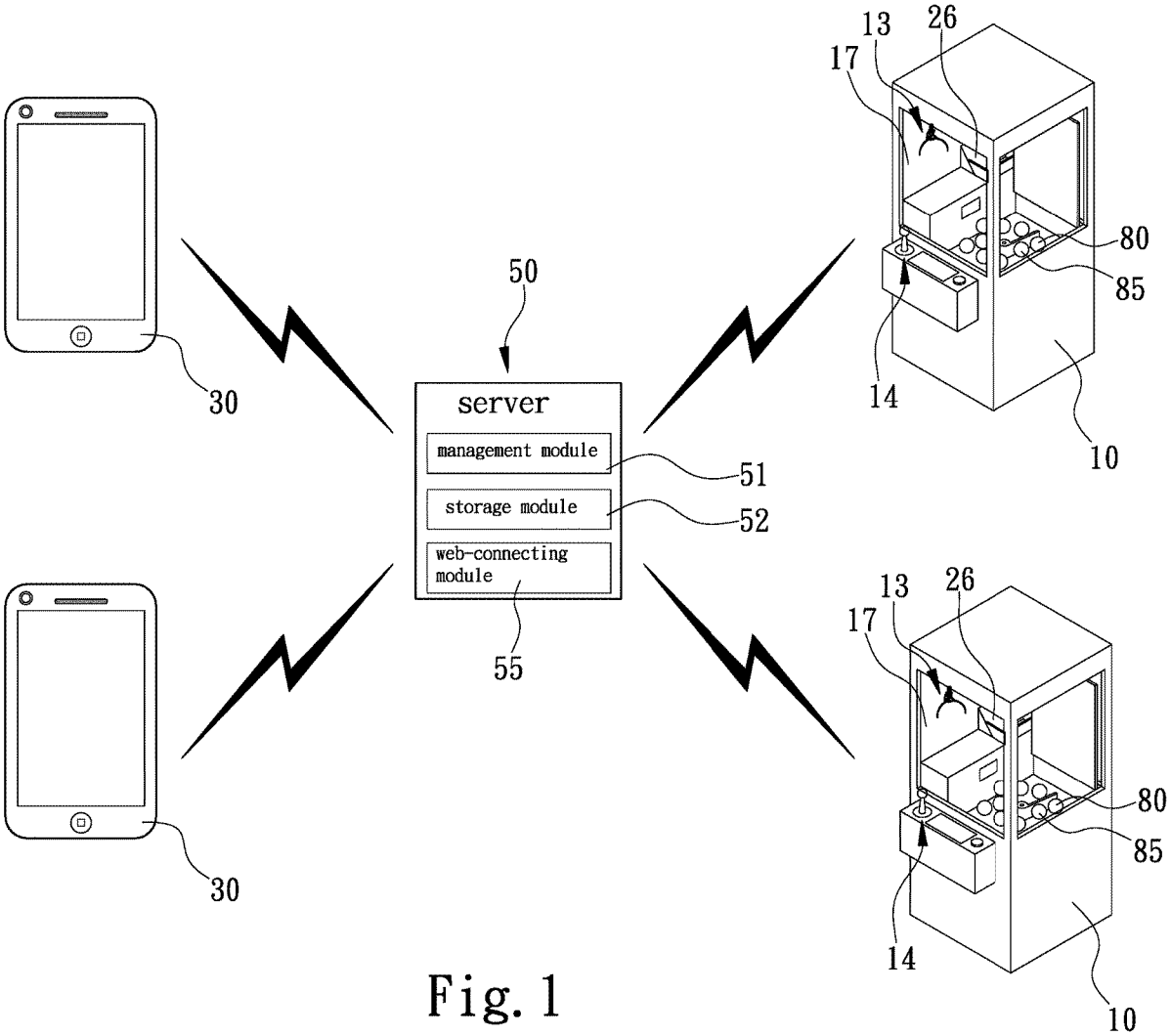
FIG. 1 is a block diagram of an interactive treasure-hunting game system according to the preferred embodiment of the present invention.

Referring to FIG. 1, an interactive treasure-hunting game system includes at least one treasure-hunting game machine 10 located in a store, at least one portable device 30 held by a player and a server 50 used by a platform provider according to the preferred embodiment of the present invention. The interactive treasure-hunting game system includes two treasure-hunting game machines 10 and two portable devices 30 in the following description. The treasure-hunting game machines 10, the portable devices 30 and the server 50 can be connected to one another via internet.

Figure 2:
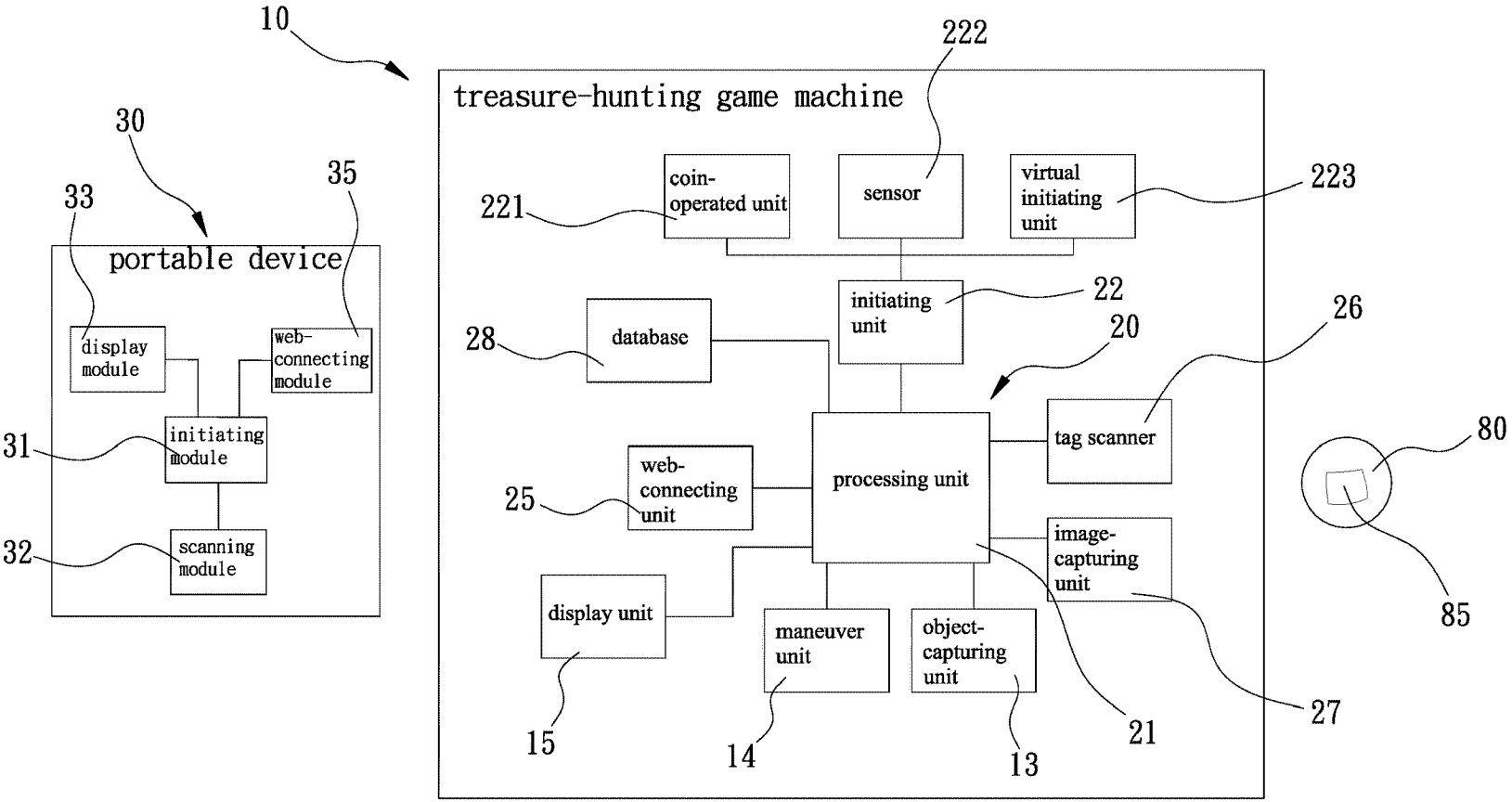
FIG. 2 is a block diagram of a game machine and a portable device of the interactive treasure-hunting game system shown in FIG. 1.

Referring to FIGS. 1 and 2, each of the treasure-hunting game machines 10 is shaped like a telephone booth that includes a space 100 for containing objects 80 in the form of balls or fluff dolls that can roll. In the preferred embodiment, each of the objects 80 is a ball that contains a product, a tag or a ticket for example. Each of the objects 80 includes an RFID tag 85 preferably operated at 120 to 180 KHz. The RFID tags 85 can be passive, semi-passive or active RFID tags. The RFID tags 85 can be read-only or read-and-write RFID tags. The RFID tags 85 can be scanned to provide numbers, alphabets, words or graphics.

The game machine includes an object-capturing unit 13, a maneuver unit 14, a display unit 15, an identification unit 17 and a stirrer 18. The object-capturing unit 13, the identification unit 17 and the stirrer 18 are inserted in the space 100. The maneuver unit 14 and the display unit 15 are supported on the treasure-hunting game machine 10, out of the space 100.

The space 100 can be opened to allow the objects 80 to be inserted in or taken from the space 100. The space 100 can be closed to keep the objects 80 therein. The space 100 includes a capture area 101 and a scan area 102. The capture area 101 contains the objects 80. The scan area 102 includes a basket 105 and a chute 106. A lower end of the basket 105 is in communication with an upper end of the chute 106. A lower end of the chute 106 is in communication with the capture area 101. Thus, the objects 80 can fall into the capture area 101 from the scan area 102 via chute 106.

The object-capturing unit 13 is inserted in an upper portion of the space 100. The object-capturing unit 13 can include a claw or a blower to drive the objects 80. The object-capturing unit 13 includes two tracks 131, a bar 132 and a claw 135 in the preferred embodiment. The tracks 131 extend parallel to each other and are provided in the upper portion of the space 100 of the treasure-hunting game machine 10. A bar 132 is movably supported on the tracks 131. The claw 135 is connected to and dangles from the bar 132. The claw 135 is movable along the bar 132. Moreover, the claw 135 is movable up and down relative to the bar 132. For using the tracks 131 and the bar 132, the claw 135 is movable in the space 100 in a three-dimensional manner. The claw 135 can be opened and closed to capture a selected one of the objects 80. Thus, the claw 135 can carry the selected object 80 between the capture area 101 and the scan area 102.

The maneuver unit 14 is supported on the treasure-hunting game machine 10 and operable to control the object-capturing unit 13 to capture a selected one of the objects 80. The maneuver unit 14 can include a joy stick and a button. The joy stick is operated to move the claw 135. The button is operated to close the claw 135. Alternatively, the maneuver unit 14 can include a touch panel that simulates a joy stick and a button. Alternatively, the maneuver unit 14 can include a portable device such as a smart phone. Preferably, the maneuver unit 14 includes a joy stick (not numbered) and a button (not numbered).

The display unit 15 is supported on the treasure-hunting game machine 10, out of the space 100. The display unit 15 is preferably used for the maneuver unit 14. Thus, the status of maneuver with the maneuver unit 14 can be shown on the display unit 15. The display unit 15 can be used to show other data such as advertisement material.

The identification unit 17 is supported on the treasure-hunting game machine 10. The identification unit 17 is used to carry the identity and location data of the game machine. The identification unit 17 can be a sticker printed with a barcode or an image of a barcode shown on the display unit 15.

The stirrer 18 is inserted in the capture area 101 of the space 100 of the treasure-hunting game machine 10. The stirrer 18 can include a rotational rod, a shaking mechanism or a blower for stirring the objects 80. In the preferred embodiment, the stirrer 18 includes a rotational rod.

The cover 19 is located in the capture area 101 of the space 100. The cover 19 is used to keep the objects 80 from the stirrer 18 to increase effects entertainment.

The control module 20 is inserted in the space 100 of the treasure-hunting game machine 10. The control module 20 includes a processing unit 21, an initiating unit 22, a web-connecting unit 25, a tag scanner 26 and an image-capturing unit 27. The processing unit 21 is electrically connected to the object-capturing unit 13, the maneuver unit 14, the display unit 15, the stirrer 18 and the cover 19. The processing unit 21 is used to process, send and receive commands.

The initiating unit 22 is electrically connected to the processing unit 21. The initiating unit 22 is a coin-operated unit 221 provided on the treasure-hunting game machine 10. A player can insert at least one coin in the coin-operated unit 221 to start a round of game. Alternatively, the initiating unit 22 can be a sensor 222 provided on the treasure-hunting game machine 10. A player can have a deposit card scan by the sensor 222 to start a round of game. Alternatively, the initiating unit 22 can be a virtual initiating unit 223 built in the processing unit 21. A player can has his- or herself identified by the virtual initiating unit 223 via a network such as the internet to start a round of game. The initiating unit 22 can be a combination of two or all of these elements.

The web-connecting unit 25 is used to communicate game data with the internet via cables or in a wireless manner.

The tag scanner 26 is located in the scan area 102 of the space 100 of the treasure-hunting game machine 10. The tag scanner 26 is electrically connected to the processing unit 21. The tag scanner 26 is used to scan the RFID tags 85 of the objects 80. The data obtained by the tag scanner 26 are shown on the display unit 15. Preferably, the tag scanner 26 can be used to write in the RFID tags 85 of the objects 80.

The image-capturing unit 27 is supported on the treasure-hunting game machine 10, out of the space 100. The image-capturing unit 27 is electrically connected to the processing unit 21. The image-capturing unit 27 is used to take images of the environment around the treasure-hunting game machine 10 and players. The images of the players can be used for identification of the players.

The database 28 is located in the treasure-hunting game machine 10. The database 28 is electrically connected to the processing unit 21. The database 28 is used to record game data and image data.

Each of the portable devices 30 is a smart phone, a tablet computer or any other proper portable device in which an application program can be installed. The portable device 30 includes an initiating module 31, a scanning module 32, a display module 33 and a web-connecting module 35. The initiating module 31 is preferably a built-in application program for processing game data. The display module 33 is used to show the application programs and the game data. The display module 33 is preferably a touch panel. The scanning module 32 is used to obtain the identity data of the treasure-hunting game machine 10. The scanning module 32 can be a touch panel operable to enter the identity data of the treasure-hunting game machine 10 or a camera operable for scanning a barcode of the treasure-hunting game machine 10. The web-connecting module 35 is adapted for wireless connection of the portable device 30 to the server 50 via internet to communicate the game data.

The server 50 includes a management module 51, a storage module 52 and a web-connecting module 55. The management module 51 is preferably a back-stage management program used with the storage module 52 to collection, statistics and management of game data and maneuver by a manager. The storage module 52 is used to record the identity data of each player, the identity and management data of each treasure-hunting game machine 10. The web-connecting module 55 is used for connection to the treasure-hunting game machine 10 and the portable device 30 to communicate the data.

The server 50 sends a game mission to the portable device 30 of each player to allow the player to use the portable device 30 to confirm a qualified treasure-hunting game machine 10 and initiates connection. Each player uses the object-capturing unit 13 of the treasure-hunting game machine 10 to capture a selected one of the objects 80 in the space 100, and uses the scan unit 26 to scan the tag 85 in the scan area 102. The code carried by the RFID tag 85 of the objects 80 is shown on the display unit 15 and used for a game mission after the game data are sent to the server 50.

Figure 3:
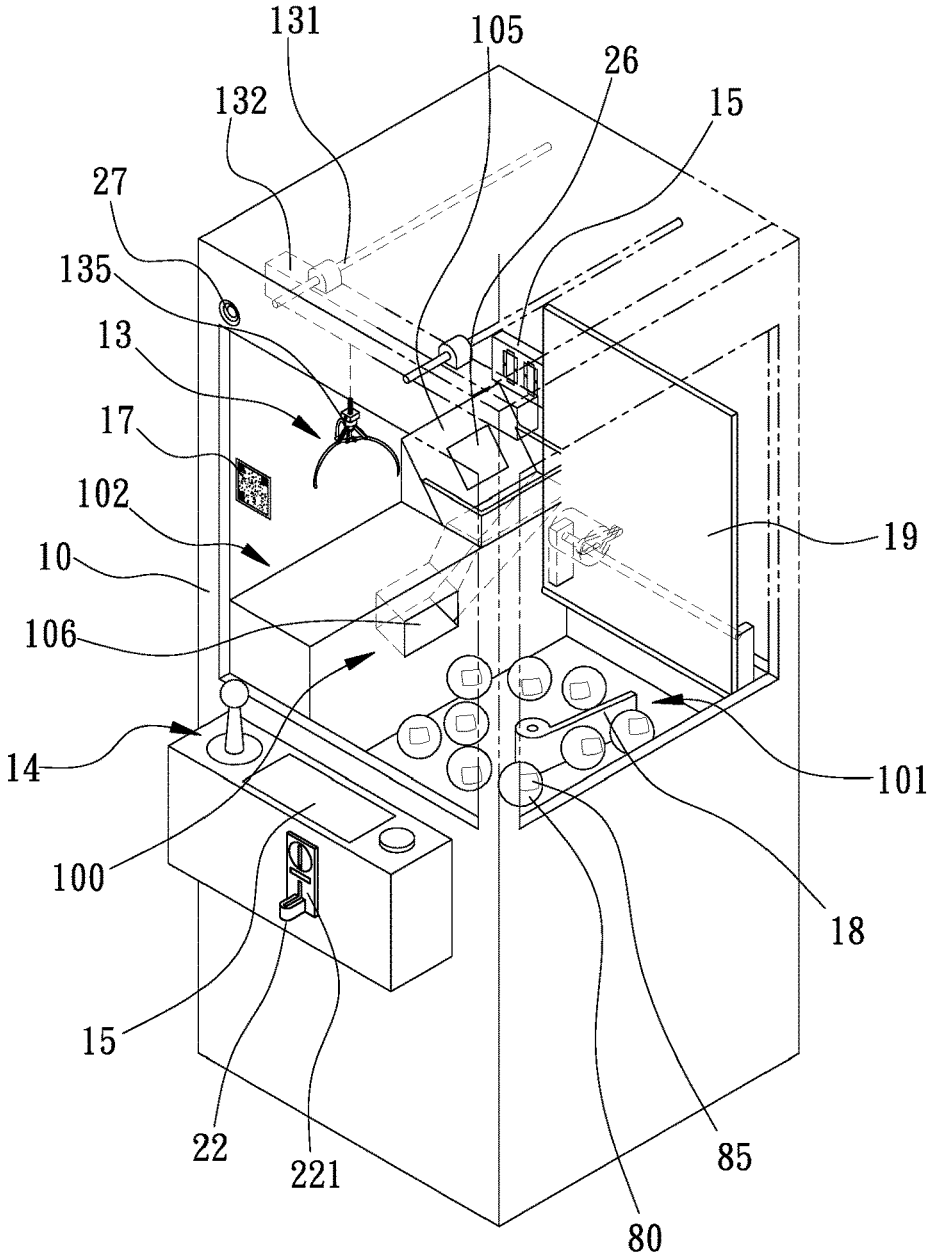
FIG. 3 is a perspective view of the game machine of the interactive treasure-hunting game system shown in FIG. 1.
Figure 4:
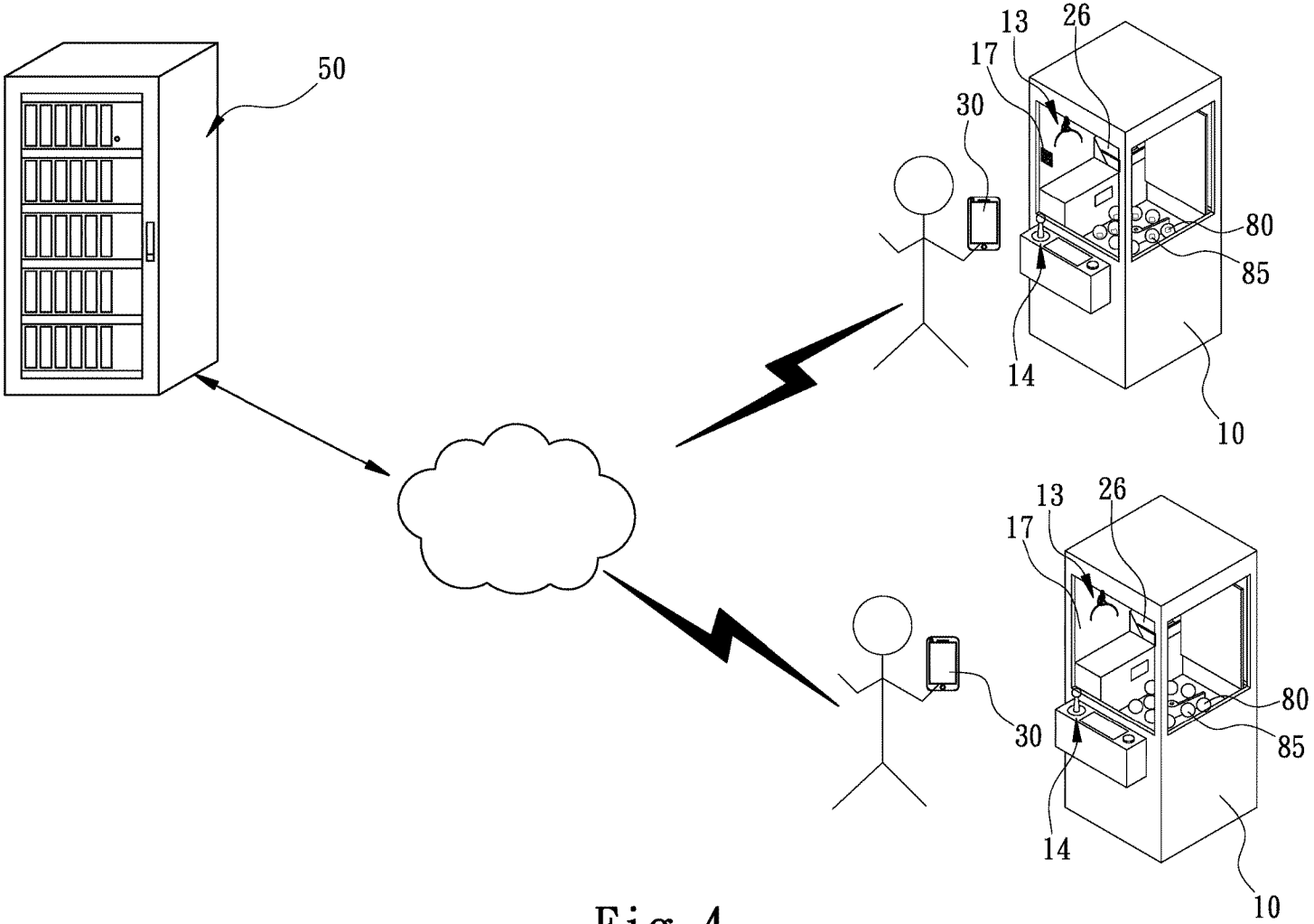
FIG. 4 is a perspective view of the interactive treasure-hunting game system shown in FIG. 1.

Referring to FIG. 3, the operation of the treasure-hunting game machine 10 of the interactive treasure-hunting game system will be described. The objects 80 provided with the RFID tags 85 are located in the capture area 101 of the space 100, and the objects 80 in the capture area 101 are covered by the cover 19. The stirrer 18 stirs the objects 80 (FIG. 4). Then, via the processing unit 21, the player uses the control unit 14 to move the claw 135 of the object-capturing unit 13 to capture a selected one of the objects 80 in the capture area 101 of the space 100. After capturing an object 80, the claw 135 of the object-capturing unit 13 drops the object 80 on to the scan area 102 of the space 100. Thus, the scan unit 26 scans the RFID tag 85 of the object 80 in the scan area 102. The processing unit 21 of the control module 20 translates the code to numbers, alphabets, words or graphics and shows them on the display unit 15. The player is allowed to continue to play the game in the above-discussed manner until the game is over if the game is bingo or a puzzle for example. Then, the game data are used for the store for marketing or giving away prizes or rounds of game. The fun with the treasure-hunting game system is increased.

Figure 5:
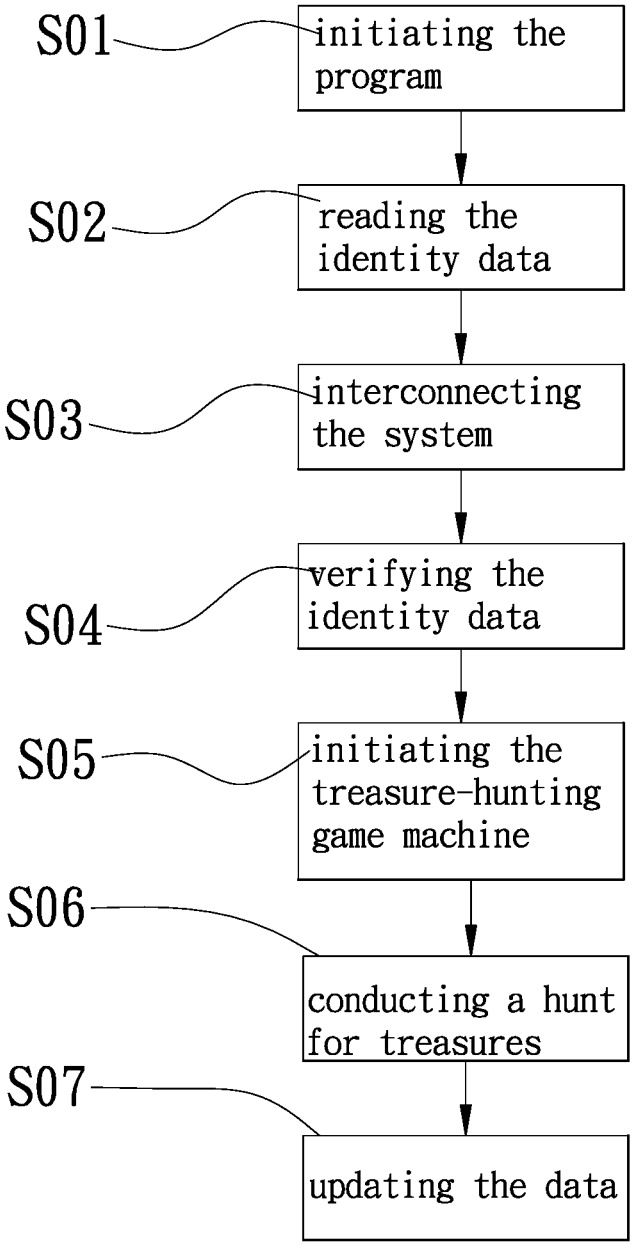
FIG. 5 is a flow chart of method for operating the interactive treasure-hunting game system shown in FIG. 1.
Figure 6:
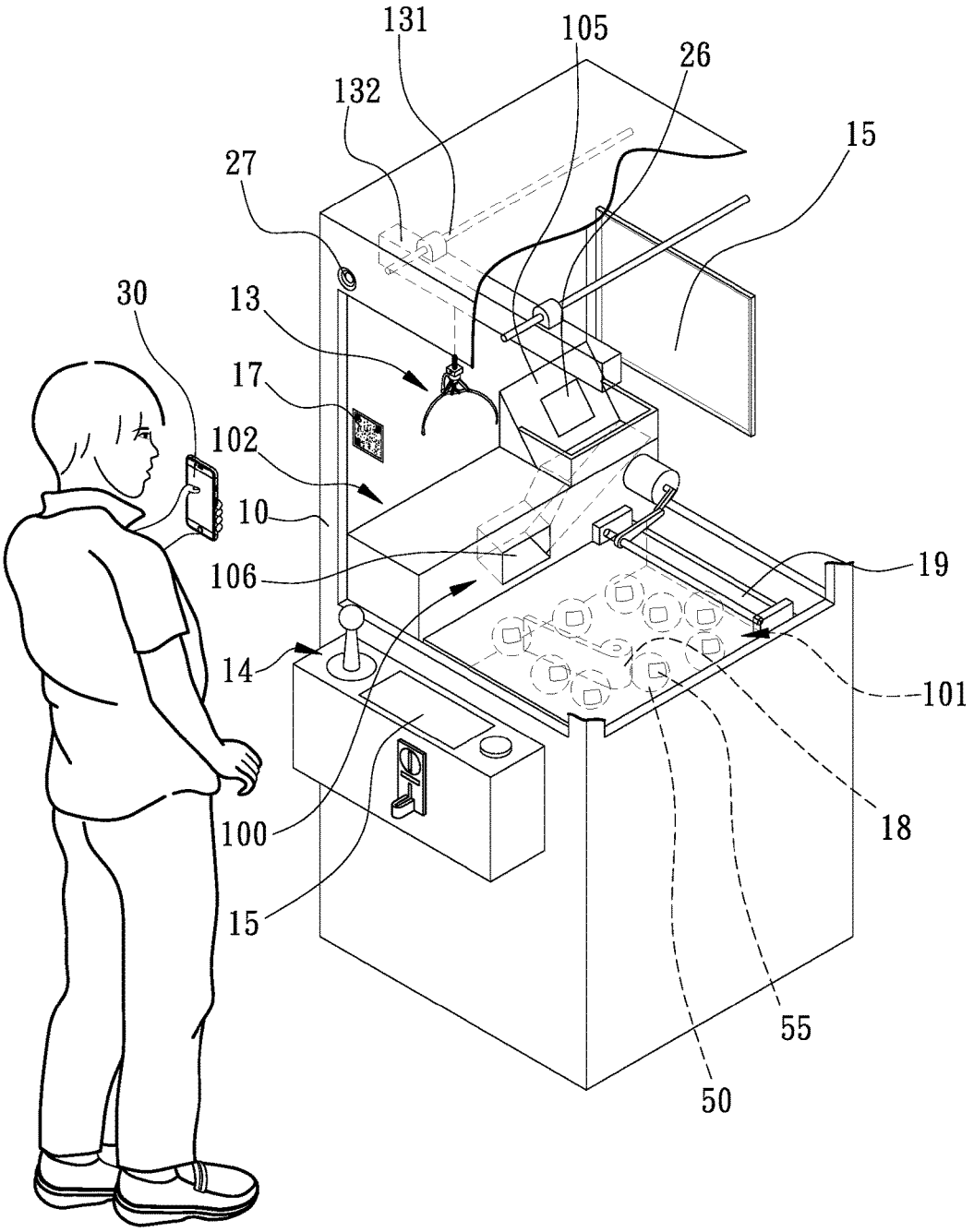
FIG. 6 is a perspective view of a player and the interactive treasure-hunting game system shown in FIG. 1.

Referring to FIGS. 4 through 6, a method for operating the interactive treasure-hunting game system will be described. Before the operation, an application program is installed in the portable device 30 to provide the initiating module 31.

At S01, the program is initiated. The player turns on the initiating module 31 of the portable device 30, and logs in with a previously registered identity.

At S02, the identity data are read. After the player logs in, the scanning module 32 of the portable device 30 scans the identification unit 17 of the treasure-hunting game machine 10. The identification unit 17 can be a QR code printed on a sticker or shown on the display module 16. Alternatively, the player can use the touch panel of the portable device 30 to enter the identity data of the treasure-hunting game machine 10.

At S03, the system is interconnected. The web-connecting module 35 of the portable device 30 of the player is connected to the web-connecting module 55 of the server 50, and the identity data of the player and that of the treasure-hunting game machine 10 are sent to the server 50.

At S04, the identity data are verified. The management program of the management module 51 of the server 50 checks the identity data to determine whether if the identities of the player and treasure-hunting game machine 10 are qualified. The process returns to S01 and the player is invited to register for membership if the player is not a qualified player. The process is terminated if the treasure-hunting game machine 10 is not a qualified machine. The process goes to S05 if both of the player and the qualified treasure-hunting game machine 10 are qualified.

At S05, the treasure-hunting game machine 10 is initiated. After verifying the player and the treasure-hunting game machine 10, based on a deposit by the player, payment by a third party or a right to a free-of-charge round of game stored in the storage module 52, the server 50 sends a signal to the virtual initiating unit 223 of the initiating unit 22 of the treasure-hunting game machine 10 to start the treasure-hunting game machine 10. Moreover, the server 50 sends a game mission command to the treasure-hunting game machine 10.

At S06, a hunt for treasures is conducted. The player uses the control module 14 of the treasure-hunting game machine 10 to control the object-capturing unit 13 to capture a selected one of the objects 80. The treasure-hunting game machine 10 is operated as described above. The scan unit 26 scans the RFID tag 85 of the object 80 in the scan area 102 of the treasure-hunting game machine 10 before the processing unit 21 of the control module 20 translates the code to numbers, alphabets, words or graphics and shows them on the display unit 15. Then, the player takes the game mission commands from the server 50. The player can be instructed to accomplish a game mission with various treasure-hunting game machines 10. Alternatively, the player can join other players to achieve a game mission or take part in a contest.

At S07, the data are updated. After the player terminates the game with the treasure-hunting game machine 10 according to the game mission commands, the treasure-hunting game machine 10 uses the web-connecting module 25 of the processing unit 21 to send the game data to the server 50. The management module 51 of the server 50 conducts back-stage statistics, analysis, comparison and management of the game data, and records them in the storage module 52 for promotion and/or rewards in the future. Then, the round of game is terminated.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An interactive treasure-hunting game system comprising:

at least one treasure-hunting game machine comprising:

a space comprising a capture area fir containing objects each provided with an RFID tag and a scan area in communication with the capture area;

an object-capturing unit located in the space thereof;

a maneuver unit provided thereon and operable to control the object-capturing unit to capture one of the objects from the capture area and then drop the object into the scan area;

a display unit provided thereon; and an identification unit provided thereon;

a control module located in the treasure-hunting game machine and comprising:

a processing unit electrically connected to the object-capturing unit, the maneuver unit and the display unit;

an initiating unit electrically connected to the processing unit;

a tag scanner located in the scan area of the treasure-hunting game machine, electrically connected to the processing unit, and adapted for scanning the RFD tag of the object so that a code carried by the RFID tag of the object can be translated and shown on the display unit;

at least one portable device comprising an initiating module for obtaining identity data of a player and that of the treasure-hunting game machine, a scanning module for reading the identification unit of the treasure-hunting game machine, and a web-connecting module for communicating data via the internet; and a server comprising a management module, a storage module used with the management module to run statistics and management of game data of the player, and a web-connecting module for connection to the portable device.

2. The interactive treasure-hunting game system according to claim 1, wherein the treasure-hunting game machine comprises:

a basket located in the scan area of the space; and a chute comprising an upper end in communication with the basket and a lower end in communication with the capture area so that the object dropped into the scan area falls back into the capture area via the chute.

3. The interactive treasure-hunting game system according to claim 1, wherein the treasure-hunting game machine further comprises a stirrer located in the capture area of the space and adapted for stirring the objects.

4. The interactive treasure-hunting game system according to claim 3, wherein the treasure-hunting game machine further comprises a cover located in the capture area of the space and adapted for covering the objects, which are stirred by the stirrer.

5. The interactive treasure-hunting game system according to claim 1, wherein the processing unit comprises an image-capturing unit provided on the treasure-hunting game machine and adapted for taking images of the environment around the treasure-hunting game machine for identification.

6. The interactive treasure-hunting game system according to claim 1, wherein the RFID tag is a passive RFD tag operated at 120 to 150 KHz.

7. The interactive treasure-hunting game system according to claim 1, wherein the initiating module comprises an application program.

8. The interactive treasure-hunting game system according to claim 1, wherein the management module comprises a back-stage management program.

9. The interactive treasure-hunting game system according to claim 1, wherein the management module is back-stage management program.

10. A method for using the interactive treasure-hunting game system according to claim 1, comprising the steps:

initiating the system by turning on the initiating module of the portable device to log in;

reading the identity data of the treasure-hunting game machine by using the scanning module of the portable device to scan the identification unit of the treasure-hunting game machine;

connecting the system by connecting the portable device to the server via the web-connecting modules, and sending the identity data of the player and the identity data of the treasure-hunting game machine to the server;

checking the identities by using the management module of the server to check the identity data of the player and the identity data of the treasure-hunting game machine sent from the portable device to determine whether if the player and the treasure-hunting game machine are qualified, and turning to the step of initiating the system to invite the player to register for membership if the player is not a qualified player, or terminating the game if the treasure-hunting game machine is not a qualified machine;

turning on treasure-hunting game machine if the player and the treasure-hunting game machine are qualified by using the server to send the game mission command to the treasure-hunting game machine, and instructing the virtual initiating unit of the initiating unit of the treasure-hunting game machine to turn on the treasure-hunting game machine according to the data stored in the storage module;

starting a round of game by allowing the player to use the control module of the treasure-hunting game machine to control the object-capturing unit to capture a selected one of the objects, using the scan unit of the treasure-hunting game machine to scan the RFID tag of the object, and using the processing unit of the control module to translate the code carried by the RFID tag to numbers, alphabets, words or graphics and show them on the display unit to invite the player to play the game according to the game mission commands from the server;

updating the data after the player stops playing with the treasure-hunting game machine by using the processing unit to send the game data to the management module of the server via the web-connecting modules to allow the server to run statistics, analysis, comparison and management on the data and store the game data in the storage module.

* * * * *